US005655055A

United States Patent [19]

Goldstein et al.

[11] Patent Number: 5,655,055

[45] Date of Patent: Aug. 5, 1997

[54] OMNIDIRECTIONAL SPACE HEATER HAVING ADJUSTABLE, ARCUATE BAFFLES

[75] Inventors: Andrew Goldstein, Newton, Mass.; Lawrence M. Kula, Nashua, N.H.

[73] Assignee: Holmes Products Corp., Milford, Mass.

[21] Appl. No.: 542,843

[22] Filed: Oct. 13, 1995

[51] Int. Cl.[6] ..... F24D 15/02; F24F 1/04; F24H 3/04

[52] U.S. Cl. ..... 392/367; 392/368; 392/374

[58] Field of Search ..... 392/367, 360, 392/361, 363–366, 368–370, 373, 375–385; D23/335, 332; 454/358, 367; 415/166, 211.1, 211.2, 208.2–210.1; 416/23; 165/DIG. 315, DIG. 311, 125, 126; 239/437, 568, 438–441, 443, 444, 449, 455–458, 460, 505–507, 451

[56] References Cited

U.S. PATENT DOCUMENTS

| | | | |
|---|---|---|---|
| 1,705,812 | 3/1929 | Fisher | 392/367 |
| 1,706,515 | 3/1929 | Barber | 392/367 |
| 1,749,039 | 3/1930 | Lincecum | 392/367 |
| 1,903,219 | 3/1933 | Landis | 392/367 |
| 2,583,754 | 1/1952 | Theisen | 392/367 |
| 2,712,053 | 6/1955 | Gallay | 392/367 |
| 3,669,428 | 6/1972 | Jones | 263/19 D |
| 4,593,179 | 6/1986 | Schulz et al. | 392/365 |
| 4,602,146 | 7/1986 | Barns et al. | 392/384 |
| 5,157,757 | 10/1992 | McDougall | 392/383 |

FOREIGN PATENT DOCUMENTS

| | | | |
|---|---|---|---|
| 929954 | 1/1948 | France | 392/367 |
| 936904 | 8/1948 | France | 392/367 |
| 985715 | 7/1951 | France | 392/367 |
| 2486781 | 1/1982 | France | 392/384 |

*Primary Examiner*—Philip H. Leung
*Assistant Examiner*—T. T. Dang
*Attorney, Agent, or Firm*—Hoffmann & Baron

[57] ABSTRACT

A portable forced air space heater having a three hundred sixty degree peripheral dispersion pattern. The heater has a tubular housing and a fan forcing air past a heating element upwardly within the housing. The air encounters a conical deflector which redirects the air to flow outwardly at the top of the housing. One or more movable baffles are selectively placed in the housing so as to obstruct discharge of air at various selected sections of the peripheral pattern of discharge. This feature prevents injurious or otherwise objectionable discharge of heat when the heater is placed close to another object. The baffles are arcuate, so that they cooperate with the tubular housing, and insulated to minimize propogation of heat to the obstructed portion of the discharge pattern. Baffles are removable from the heater, and are maneuvered for adjusting their position from outside the heater.

5 Claims, 4 Drawing Sheets

OMNIDIRECTIONAL SPACE HEATER HAVING ADJUSTABLE, ARCUATE BAFFLES

BACKGROUND OF THE INVENTION

1. Field of the Invention

The present invention relates to a portable forced air heater for heating occupied space, which heater projects heat radially universally in all horizontal directions from the heater in a three hundred sixty degree pattern. The heater has removable and adjustable shields for limiting heat propogation to less than the three hundred sixty degree pattern, so that objects near the heater will not be exposed to excessive heat.

2. Description of the Prior Art

Portable forced air heaters are known in the prior art. Such heaters generally include a heat source and a fan forcing air past the heat source and into a room or other space being heated. Depending upon the precise nature of the heater, heated air may be ejected in a selected direction, in several directions, or throughout an angle encompassing many different directions. The latter possibility includes three hundred sixty degree discharge.

Certain situations are most advantageously addressed by providing three hundred sixty degree discharge, such as heating of the room of a building by a heater centrally located within that room. The prior art has provided heaters having this feature.

U.S. Pat. No. 3,229,070, issued to Orville C. Wells on Jan. 11, 1966, describes a portable heater having a three hundred sixty degree dispersion pattern of heated forced air. A frustoconical structure guides incoming air into a blower located below. In contrast to this invention, wherein the discharge pattern of heated air is fixed, the present invention makes provision for optionally blocking discharge in selected directions. Another difference is that the air flow through the respective heaters is different. Wells draws air from above, whereas the present invention draws air from its lowermost periphery.

Portable heaters having heat dispersed through a three hundred sixty degree pattern, each including a conical structure deflecting forced heated air, are shown in U.S. Pat. Nos. 1,900,956, issued to William W. Somersall on Mar. 14, 1933, and 5,245,692, issued to Yuzou Kawai on Sep. 14, 1993. In contrast to the present invention, both Kawai and Somersall lack means for modifying or limiting their respective heat dispersion patterns. Also, neither Somersall nor Kawai insulates his conical structure as is performed in the present invention. Rather, in a departure from the practice of the present invention, Somersall intentionally passes some of the heat through the conical structure to expedite evaporating water for humidification. Kawai locates his conical structure within the air stream prior to heating, unlike the present invention. Kawai also draws air through his heater in a direction opposite that of the present invention.

U.S. Pat. No. 3,775,590, issued to William Joseph Gartner on Nov. 27, 1973, sets forth a portable forced air heater wherein heat is discharged radially and horizontally through a three hundred sixty degree pattern. However, unlike the present invention, Gartner makes no provision for limiting the discharge pattern.

An industrial facility heater is shown in U.S. Pat. No. 4,103,146, issued to John F. Rampe on Jul. 25, 1978. This heater has a significant characteristic that it heats spaces having high ceilings, and accomplishes this by moving a relatively great volume of heated air. A significant effect of this invention is to redistribute a heated stratum of air which would otherwise accumulate at the ceiling. The apparatus includes a vertically oriented square or rectangular air shaft. Large areas of the uppermost and lowermost sections of the air shaft are formed by screened panels, so that there is no solid walled air conduit. Air is discharged horizontally through four parallelepiped faces of the upper sections of the air shaft. Make-up air migrates radially toward the bottom of the air shaft to complete a cycle.

It should be noted that this scheme successfully causes an air flow of great volume, but does not truly disperse the air throughout a three hundred sixty degree pattern. Rather, the dispersion pattern is cruciform. By contrast, the dispersion pattern of the present invention describes a full three hundred sixty degree pattern. In another departure from the device of Rampe, the present invention has provision for optionally blocking discharge in selected directions. As Opposed to the present invention, the discharge pattern of Rampe is fixed.

None of the above inventions and patents, taken either singly or in combination, is seen to describe the instant invention as claimed.

SUMMARY OF THE INVENTION

The present invention addresses the difficulties of finding a truly suitable location within a room for a heater. A central location within a room may be preferred for purposes of heat distribution. However, the central portion of the room may be devoted to other uses, such as foot traffic, and thus may not be suitable for a heater. Also, this location may cause a power cord to be out of reach of a power receptacle, or hazardously exposed to foot traffic, children, pets, and other influences.

Therefore, it may be more suitable to locate a heater against a wall, in the corner of the room, or beside a large object, such as furniture. It would be counterproductive and in some cases hazardous to discharge heated air against building walls, furniture, or near easily damaged or flammable objects. Such objects could include curtains, fabric furniture covers, and the like.

The present invention enables the pattern of heat propogation to be limited to a pattern of discharge which the user judges most suitable for conditions. One or more insulated shields or baffles are disposed at peripheral locations close to hazardous objects, or ineffectual for heat distribution. The baffles are positioned to obstruct discharge of heated air at the obstructed locations.

Each baffle is arcuate, in order to cooperate with the tubular housing of the heater, and insulated to minimize propogation of heat in the unintended direction, thus maximizing heat within the heated air. Arcuate configuration of the baffles enables the baffles to occupy minimal volumes of space within the housing. The baffles are removable from the heater, to allow a three hundred sixty degree air discharge pattern. They are also repositionable, and may be grouped adjacent to one another, so that the obstructed area is variable at will.

The heater has a vertically oriented, tubular body which configuration is in accordance with upward air flow, and with the horizontal, outward, radial discharge of air throughout the three hundred sixty degree pattern. Slots are formed in the lateral wall of the housing to pass heated air to the exterior of the heater. An inverted cone is located at the top of the air passageway to divert the air stream from vertical to conform to the discharge pattern.

One or more openings are formed in the top wall of the housing. Each baffle has a handle projecting through these openings, so that the baffles may be grasped and repositioned without opening or disassembling the heater.

A fan is located within the housing to propel air past a heating element. Manual controls for the heater are located at the top of the housing.

Accordingly, it is a principal object of the invention to provide a portable forced air heater discharging air in a pattern radiating horizontally from the heater about a three hundred sixty degree pattern.

It is another object of the invention to reduce the three hundred sixty degree pattern of discharged heated air as desired by obstructing air flow.

It is a further object of the invention to minimize heat propogation in the obstructed direction.

It is an additional object of the invention to provide one or more removable baffles for obstructing heated air from being discharged in a selected direction.

It is again an object of the invention that the baffles cooperate with the, housing of the heater.

Another object of the invention is that the housing of the heater be tubular and vertically oriented, and discharge heated air at the top of the housing.

Yet another object of the invention is that the baffles cooperate with the configuration of the housing, and occupy minimal space.

Still another object of the invention is that the baffles be insulated, so that heat discharged in the obstruction is minimized, and heat retained within the heated air is maximized.

A still further object of the invention is that the baffles be graspable and adjustable with respect to position from the.exterior of the heater.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Various other objects, features, and attendant advantages of the present invention will become more fully appreciated as the same becomes better understood when considered in conjunction with the accompanying drawings, in which like reference characters designate the same or similar parts throughout the several views, and wherein.

DETAILED DESCRIPTION OF THE PREFERRED EMBODIMENTS

Figure 1:
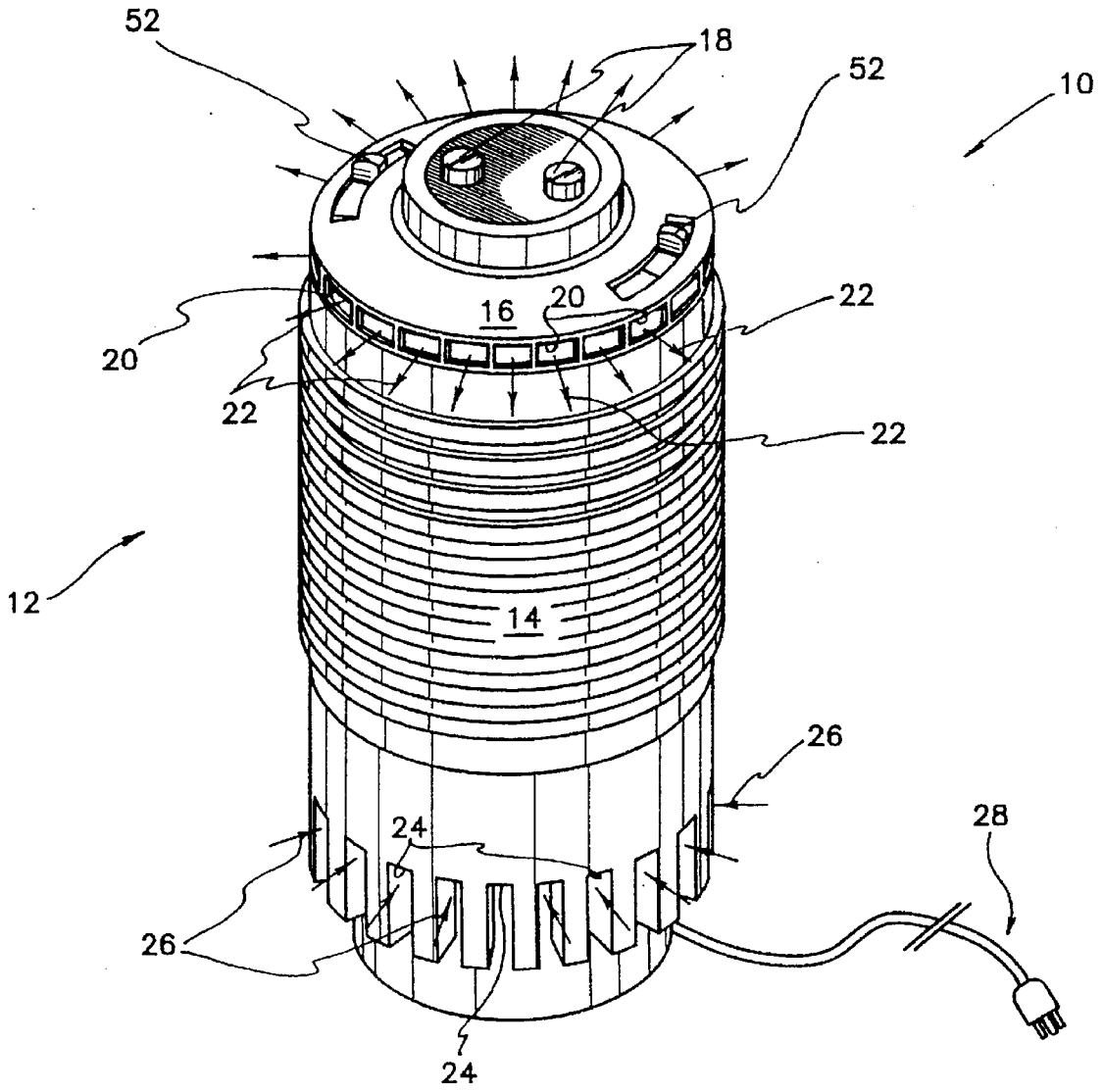
FIG. 1 is a perspective view of the invention.

As seen in FIG. 1, the invention comprises an omnidirectional, portable space heater 10 having a housing 12 including a lateral wall 14 and a top wall 16, on which are mounted manual controls 18. Manual controls 18 regulate functions such as overall heater actuation, thermostatic control, and the like, in conventional fashion, and will not be described further.

Slots 20 are formed in lateral wall 14 just below top wall 16, so that heated air, indicated by arrows 22, is discharged radially outwardly and horizontally, in a three hundred sixty degree peripheral pattern. Omnidirectional will be understood to encompass outward radial dispersion of heated air in a horizontal plane intersecting slots 20.

Air is drawn into heater 10 through lower slots 24, air flow indicated by arrows 26. Air flow through heater 10 is upward. Since heater 10 is a portable appliance intended for household applications, electrical power is conducted by plug and cord 28.

Figure 2:
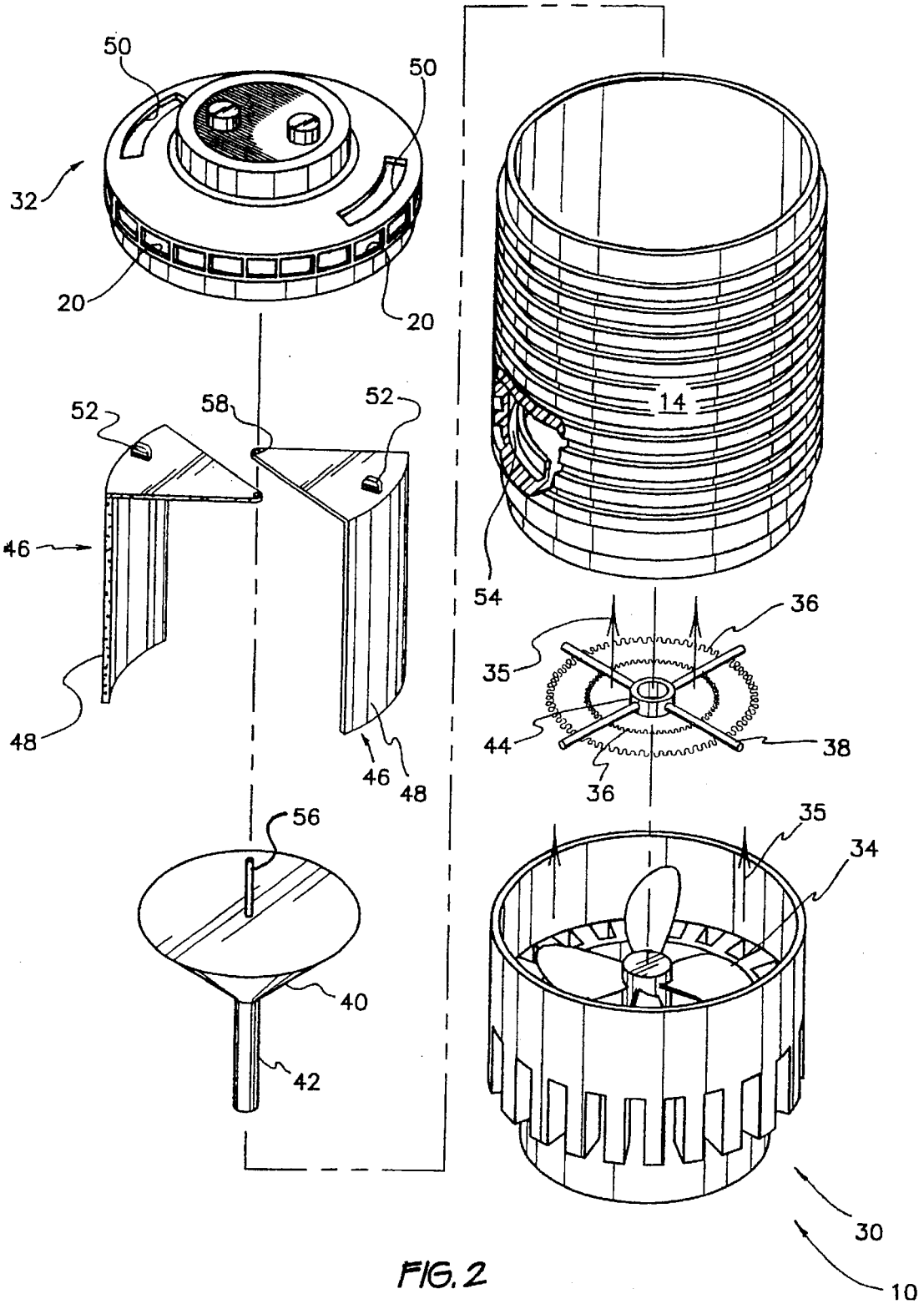
FIG. 2 is an exploded, perspective view of the invention, partly broken away to reveal internal detail.

FIG. 2 shows internal construction of heater 10. Housing 12 is formed in three separate sections for convenience of fabrication and assembly, including base 30, lateral wall 14, and top section 32. Base 30 supports an axial fan 34 which propels air upwardly, indicated by arrows 35, past heating elements 36. Heating elements 36 are mounted on a supporting structure 38, and may be of any suitable type, and are disposed in heat exchange relation with respect to air flowing through heater 10.

Air continues to flow upwardly, eventually impinging upon a tapered air deflector 40. Air deflector 40 may be of any tapered configuration greater in diameter at the top than at the bottom. In this respect, air deflector 40 is depicted as an inverted cone or frustocone, but could be of other configurations, such as parabolic, pyramidal, or bell shaped, among others. Air deflector 40 serves the purpose of redirecting air to be discharged radially and horizontally from heater 10 through slots 20 formed in top section 32.

Air deflector 40 is insulated, to conserve the heat of discharged air, and to protect components and exposed surfaces above. Air deflector 40 is supported on column 42, which rests in hub 44 of structure 38.

To prevent undesired discharge of heated air in selected directions, baffles 46 are disposed within heater 10 so as to obstruct selected slots 20. Vertical walls 48 of baffle 46 are arcuate, spaced apart from and guided by lateral wall 14, and cooperate concentrically with lateral wall 14 of heater 10. Baffles 46 may be moved around the periphery of lateral wall 14, walls 48 of baffles 46 remaining parallel to lateral wall 14 of heater 10. Baffles 46 are selectively movable to any position along lateral wall 14 to prevent heated air from impinging on an environmental surface at the selected position.

It will be apparent that as a baffle 46 is moved or rotated with respect to lateral wall 14, various slots 20 will be obstructed, while an equivalent number of other slots 20 will be exposed. Thus, slots 20 which are exposed may occur at selected positions around three hundred sixty degrees of circumference of housing 12, although air will never be discharged uniformly through all slots 20 simultaneously.

This feature enables heater 10 to be positioned near other objects in a room. For example, heater 10 may be located near a window (not shown), which would otherwise waste heat projected onto the window in the absence of an appropriately located baffle 46. Another example is a house plant (not shown), which could be injuriously heated and dried if left in the direct path of discharged heated air.

Baffles 46 optionally may be fabricated from or coated with an insulating material. This feature minimizes wasteful or objectionable incidental propogation of heat in the protected or obstructed directions, conserves heat of discharged air, and limits temperature elevation of external surfaces of heater 10.

The overall configuration of heater 10 is tubular and vertically oriented, in the sense that the axis of the tube is vertical. Also, this configuration enables the concentric cooperation of baffles 46 with lateral wall 14 described above. Baffles 46 can be moved in infinitely variable steps along lateral wall 14, so that they are infinitely adjustable, within a range of motion limited or constrained by opening 50 formed in top wall 16 of heater 10.

Two baffles 46 are depicted in FIG. 2, and any number may be incorporated in order to vary the magnitude of the obstructed portion of the peripheral air discharge pattern of heater 10. Magnitude of the obstructed portion may be varied to assure that baffles 10 are movable to any position along lateral wall 14. Each baffle has a corresponding opening 50 located above. A handle 52 (see FIG. 1) formed as part of baffle 46 projects through its corresponding opening 50 when heater 10 is assembled, so that the angular position of baffle 46 is easily adjusted within housing 12. Thus, obstruction of air flow is adjustable from the exterior of housing 12.

Figure 3:
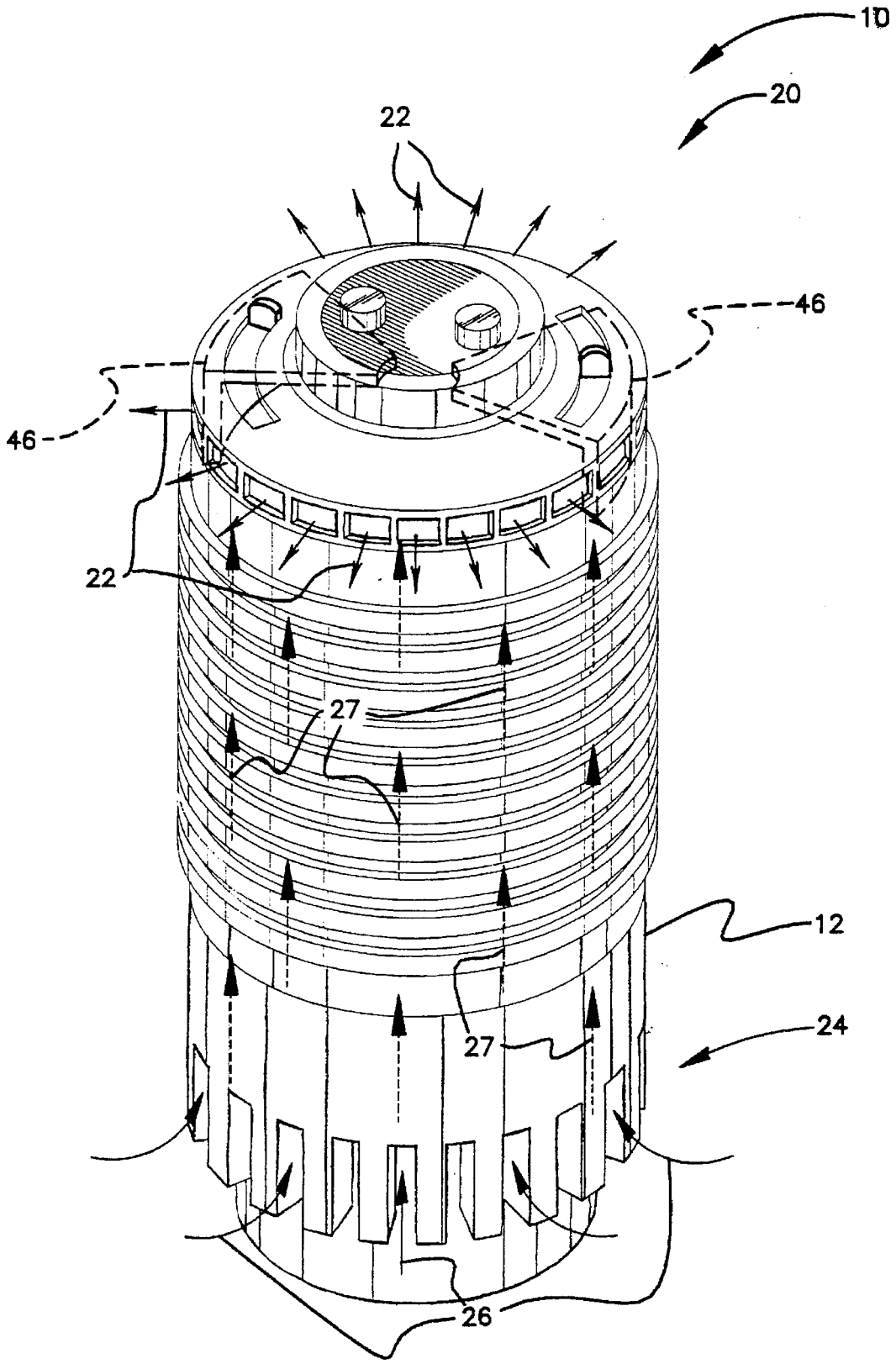
FIG. 3 is a perspective view of the invention showing air flow during operation, some details being omitted for clarity.

FIG. 3 illustrates airflow within heater 10. Air is drawn into housing 12 through lower slots 24, as indicated by arrows 26. Arrows 27 illustrate upward flow inside housing 12. Air is discharged through slots 20, as indicated by arrows 22. It will be noted that now air is discharged at zones Z, corresponding to obstruction by baffles 46.

Figure 4:
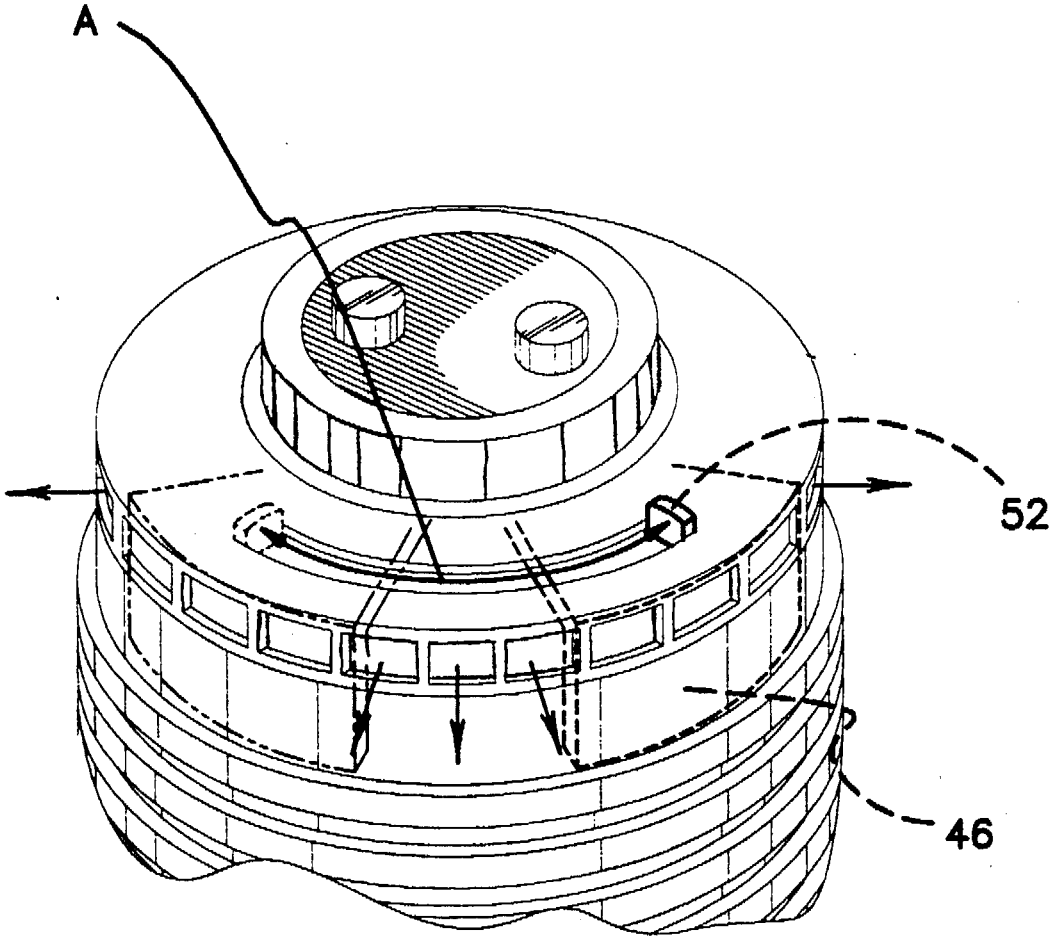
FIG. 4 is a perspective detail view taken from the upper portion of FIG. 3, illustrating adjustment of airflow obstruction baffles.

FIG. 4 shows adjustment of baffles 46 in greater detail. Each baffle 46 can be moved by grasping its handle 52. Handle 52 is constrained to sweep through an arc of motion from the position illustrated toward the right of FIG. 4 to a position toward the left of FIG. 4. Arrow A indicates the limited range of movement of handle 52. The extremes of the possible positions of baffle 46 are indicated in broken lines.

Referring again to FIG. 2, baffles 46 are supported partly in a groove 54 formed in lateral wall 14, and partly by engagement with a rod 56 projecting upwardly from air deflector 40, rod 56 penetrating holes 58 formed in each baffle 46. Rod 56 is journaled in top section 32 for steadiness.

Baffles 46 may be employed singly, in groups, or entirely removed from heater 10 for full three hundred sixty degree heat dispersion. When employed in groups, they may occupy adjacent or opposed positions to vary the obstructed portion of the periphery of heater 10 as desired.

It is to be understood that the present invention is not limited to the embodiments described above, but encompasses any and all embodiments within the scope of the following claims.

We claim:

1. An omnidirectional heater comprising:

a housing having a lateral wall having means defining a plurality of slots formed in said lateral wall and disposed about said lateral wall in a three hundred sixty degree peripheral pattern;

an axial fan inducing air to flow in an upwardly directed draft within said housing;

a heater disposed in heat exchange relation to the air flowing in the upwardly directed draft;

a tapered air deflector located at the top of said housing, said tapered air deflector redirecting heated air flowing in the upwardly directed draft within said housing to be discharged horizontally, radially outward through said slots throughout a three hundred sixty degree peripheral pattern: and a baffle for obstructing discharge of heated air from said housing, said baffle having an arcuate wall spaced from, guided by, and cooperating concentrically with said lateral wall of said omnidirectional heater, and means for moving said baffle selectively around the periphery of said lateral wall of said omnidirectional heater and selectively obstructing some of said slots while exposing an equivalent number of other said slots whereby discharge of heated air is prevented from impinging on an environmental surface at at least one selected position, said housing having a top wall and means defining at least one opening in said top wall, and said baffle having a handle projecting through said opening, whereby said baffle may be grasped and adjusted with respect to its position within said housing, obstruction of air flow thus being adjustable from the exterior of said housing.

2. An omnidirectional heater comprising:

a vertically oriented tubular housing having a lateral wall and a top wall having means defining at least one opening in said top wall, said lateral wall having means defining a plurality of slots formed in said lateral wall and disposed about said lateral wall in a three hundred sixty degree peripheral pattern;

an axial fan inducing air to flow in an upwardly directed draft within said housing;

a heater disposed in heat exchange relation to the air flowing in the upwardly directed draft;

a tapered air deflector located at the top of said housing, said tapered air deflector redirecting air flowing in the upwardly directed draft within said housing to be discharged horizontally through said slots, radially outwardly throughout a three hundred sixty degree peripheral pattern; and a plurality of arcuate, insulated baffles for obstructing discharge of heated air from said housing, said baffles being spaced from, guided by, and cooperating with said lateral wall of said housing, and infinitely adjustable within a range constrained by said housing along said lateral wall of said housing at selected positions on said housing, thereby selectively obstructing various said slots while exposing an equivalent number of others of said slots, whereby discharge of heated air is prevented from impinging on an environmental surface at said selected position, each one of said baffles having a handle projecting through said opening in said top wall of said housing, whereby said baffle may be grasped and adjusted with respect to its position within said housing, obstruction of air flow thus being adjustable from the exterior of said housing.

3. An omnidirectional heater comprising:

a housing having a lateral wall having means defining a plurality of slots formed in said lateral wall and disposed about said lateral wall in a three hundred sixty degree peripheral pattern;

an axial fan inducing air to flow in an upwardly directed draft within said housing;

a heater disposed in heat exchange relation to the air flowing in the upwardly directed draft;

a tapered air deflector located at the top of said housing, said tapered air deflector redirecting heated air flowing in the upwardly directed draft within said housing to be discharged horizontally, radially outwardly through said slots throughout a three hundred sixty degree peripheral pattern; and a baffle for obstructing discharge of heated air from a specific angular section of said housing, said baffle having an arcuate wall spaced from, guided by, and cooperating concentrically with said lateral wall of said omnidirectional heater, and means for moving said baffle selectively around the periphery of said lateral wall of said omnidirectional heater thereby selectively obstructing some of said slots in the specific angular section while exposing the remainder of said slots for discharge of heated air, whereby discharge of heated air is prevented from impinging on an environmental surface at at least one selected position.

4. The omnidirectional heater according to claim 3, said baffle having insulation means, whereby incidental propogation of heat from said baffle is minimized.

5. The omnidirectional heater according to claim 3, further comprising at least one second said baffle, whereby an obstructed portion of said peripheral pattern of discharged air is varied in magnitude.

* * * * *